US010405108B2

(12) United States Patent
Rasmussen et al.

(10) Patent No.: US 10,405,108 B2
(45) **Date of Patent: *Sep. 3, 2019**

(54) HEARING AID RADIO POWER SUPPLY

(71) Applicant: GN HEARING A/S, Ballerup (DK)

(72) Inventors: Kim Rasmussen, Ballerup (DK); Ebbe Skammelsen, Hoersholm (DK)

(73) Assignee: GN HEARING A/S, Ballerup (DK)

( * ) Notice: Subject to any disclaimer, the term of this patent is extended or adjusted under 35 U.S.C. 154(b) by 0 days.

This patent is subject to a terminal disclaimer.

(21) Appl. No.: 15/464,338

(22) Filed: Mar. 20, 2017

(65) Prior Publication Data

US 2017/0195799 A1 Jul. 6, 2017

Related U.S. Application Data

(63) Continuation of application No. 14/191,140, filed on Feb. 26, 2014, now Pat. No. 9,628,922.

(30) Foreign Application Priority Data

Feb. 24, 2014 (DK) ..... 2017 70090
Feb. 24, 2014 (EP) ..... 14156340

(51) Int. Cl.
*H04R 25/00* (2006.01)

(52) U.S. Cl.
CPC ..... *H04R 25/30* (2013.01); *H04R 25/554* (2013.01); *H04R 25/602* (2013.01); (Continued)

(58) Field of Classification Search
CPC .... H04R 1/1025; H04R 1/1041; H04R 25/30; H04R 25/43; H04R 25/554; H04R 25/602; H04R 2225/31; H04R 2225/33; H04R 2225/51; H04R 2225/59; H04R 2225/61; H04R 2420/01; H04R 2420/03; H04R 2420/07
See application file for complete search history.

(56) References Cited

U.S. PATENT DOCUMENTS 6,104,759 A 8/2000 Carkner et al.
6,381,308 B1 4/2002 Cargo et al.
(Continued)

OTHER PUBLICATIONS

Examination and Search Report dated Apr. 16, 2014 in corresponding Danish Patent Application No. PA 2014 70090 (6 pages).
(Continued)

*Primary Examiner* — Joshua Kaufman
(74) *Attorney, Agent, or Firm* — Vista IP Law Group, LLP

(57) ABSTRACT

A hearing aid includes: an input transducer configured to output an audio signal based on a signal applied to the input transducer; a processor configured to compensate a hearing loss of a user of the hearing aid and output a hearing loss compensated audio signal; an output transducer configured to output an auditory output signal based on the hearing loss compensated audio signal, wherein the auditory output signal is to be received by a human auditory system; a wireless communication unit configured to communicate wirelessly with another device; an energy storage unit coupled to supply the wireless communication unit with power; and a current limiting unit coupled for control of replenishment of the energy storage unit with energy from a power supply.

27 Claims, 3 Drawing Sheets

(52) U.S. Cl.
CPC ..... *H04R 2225/31* (2013.01); *H04R 2225/33* (2013.01); *H04R 2225/55* (2013.01); *H04R 2225/61* (2013.01); *H04R 2460/03* (2013.01)

(56) References Cited

U.S. PATENT DOCUMENTS

| | | | |
|---|---|---|---|
| 7,474,879 | B2 | 1/2009 | Turner et al. |
| 8,433,082 | B2 | 4/2013 | Abolfathi |
| 2002/0196956 | A1 | 12/2002 | Andersen et al. |
| 2007/0047749 | A1 | 3/2007 | Kasztelan et al. |
| 2007/0259629 | A1 | 11/2007 | Lee et al. |
| 2008/0205678 | A1 | 8/2008 | Boguslavskij et al. |
| 2008/0232623 | A1 | 9/2008 | Solum et al. |
| 2009/0262964 | A1 | 10/2009 | Havenith et al. |
| 2011/0103628 | A1 | 5/2011 | Bachler |
| 2011/0255722 | A1 | 10/2011 | Pedersen |
| 2012/0140963 | A1 | 6/2012 | Larsen et al. |
| 2013/0129126 | A1 | 5/2013 | Callias et al. |
| 2013/0243228 | A1 | 9/2013 | Muller |
| 2013/0243230 | A1 | 9/2013 | Angst et al. |
| 2013/0322670 | A1 | 12/2013 | Hosoi et al. |
| 2014/0043864 | A1 | 2/2014 | Kroekenstoel et al. |
| 2014/0044293 | A1 | 2/2014 | Ganem et al. |
| 2014/0241555 | A1 | 8/2014 | Terlizzi |
| 2014/0270296 | A1 | 9/2014 | Fort et al. |
| 2015/0110315 | A1 | 4/2015 | Callias et al. |
| 2015/0245148 | A1 | 8/2015 | Rasmussen et al. |

OTHER PUBLICATIONS

Extended European Search Report dated Apr. 22, 2014 in corresponding European Patent Application No. 14156340.3 (6 pages).
Second Technical Examination dated Apr. 16, 2015, for corresponding Danish Patent Application No. PA 2014 70090 (3 pages).
Third Technical Examination dated Feb. 16, 2016, for corresponding Danish Patent Application No. PA 2014 70090 (3 pages).
Communication pursuant to Article 94(3) EPC dated Apr. 22, 2016, for corresponding European Patent Application No. 14156340.3, 4 pages.
Communication pursuant to Article 94(3) EPC dated Nov. 25, 2016, for corresponding European Patent Application No. 14156340.3, 4 pages.
Non-final Office Action dated Jun. 18, 2015 for related U.S. Appl. No. 14/191,140, 8 pages.
Final Office Action dated Jan. 25, 2016 for related U.S. Appl. No. 14/191,140, 9 pages.
ESR, Table 4: Typical ESR Values of Some Capacitors in Ohms, https://my.execpc.com/~endlr/esr.html, retrieved by Internet Archive on Dec. 20, 2013.
Final Office Action dated Sep. 20, 2016 for related U.S. Appl. No. 14/191,140, 13 pages.
Notice of Allowance and Fee(s) due dated Dec. 9, 2016 for related U.S. Appl. No. 14/191,140, 12 pages.
Extended European Search Report dated Feb. 26, 2018 in corresponding European Patent Application No. 18150552.0 (7 pages).

HEARING AID RADIO POWER SUPPLY

RELATED APPLICATION DATA

This application is a continuation of U.S. patent application Ser. No. 14/191,140, filed Feb. 26, 2014, pending, which claims priority to and the benefit of Danish Patent Application No. PA 2014 70090 filed on Feb. 24, 2014, and European Patent Application No. 14156340.3 filed on Feb. 24, 2014. The entire disclosures of all of the above applications are expressly incorporated by reference herein.

FIELD OF TECHNOLOGY

A new hearing aid is provided that is configured to perform wireless communication with other devices and that has a new power supply for the wireless communication unit.

BACKGROUND

Typically, only a limited amount of power is available from the power supply of a hearing aid. For example, a conventional button cell Zinc-air battery typically supplies power to a hearing aid circuit due to its high energy density and low cost.

In the design of a hearing aid, the size and the power consumption are important considerations. The battery is a large component of the hearing aid, and to ensure compact and inconspicuous hearing aids, small sized batteries, such as the "312" and "13" types are used. However, small batteries have a relatively large internal resistance. For example, a "312" battery typically has an internal resistance of 5Ω-10Ω compared to typical internal resistance values of 0.1Ω-0.5Ω of an AA type battery. The large internal resistance causes the supply voltage to drop significantly as a function of increased output current. Voltage drops may result in reduced sound quality and/or interrupted operation of parts of the hearing aid.

A radio chip for wireless communication draws significant amounts of current during on-going transmission and reception. A conventional Zinc-air battery is only capable of supplying the required current for wireless transmission and reception for a limited time period, typically 0.5-5 milliseconds (ms). If the battery continues to supply the required amount of current for longer time periods, the supply voltage will decrease, and below a certain threshold, the hearing aid circuit, in particular digital parts of the hearing aid circuit, will not operate properly.

Further, Zinc-air batteries require time to recover after having supplied peak currents, even for limited time periods. Typically, the radio chip duty cycle, i.e. the percentage of radio turn-on time with respect to the sum of the radio turn-on and radio turn-off time, must be kept below 15%-20%.

SUMMARY

In the new hearing aid according to the appended claims, the power supply of the hearing aid, e.g. a battery, such as a Zinc-air battery, is relieved from supplying peak currents to a wireless communication unit of the hearing aid. In addition to the power supply, the wireless communication unit is supplied with power from an energy storage unit, such as one or more capacitors. The energy storage unit is replenished from the power supply through a current limiting unit, such as a resistor, an electronic current limiter, etc.

The energy storage unit, e.g. capacitor, will deliver peak currents to the wireless communication unit so that peak currents drawn from the power supply are lowered, and the current limiting unit, e.g. resistor, will limit currents drawn from the power supply during voltage drops of the energy storage unit.

Thus, a new hearing aid is provided, comprising a hearing aid circuit with an input transducer configured to output an audio signal based on a signal applied to the input transducer and representing sound, a hearing loss processor configured to compensate a hearing loss of a user of the hearing aid and output a hearing loss compensated audio signal, e.g., the hearing aid may aim to restore loudness, such that loudness of the applied signal as it would have been perceived by a normal listener substantially matches the loudness of the hearing loss compensated signal as perceived by the user, an output transducer, such as a receiver, an implanted transducer, etc., configured to output an auditory output signal based on the hearing loss compensated audio signal that can be received by the human auditory system, whereby the user hears the sound, and a wireless communication unit configured to communicate wirelessly with another device.

A power supply is connected to supply power to the hearing aid circuit.

The new hearing aid further comprises an energy storage unit that is connected to the communication unit for power supply of the communication unit.

The energy storage unit is further connected to the power supply through a current limiting unit for replenishment of the energy storage unit with energy from the power supply, whereby the energy storage unit draws lower peak currents from the power supply than if the current limiting unit was absent.

Preferably, the energy storage unit does not store magnetic energy, i.e. the energy storage unit does not contain an inductive component.

Preferably, the current limiting unit does not contain an inductive component for energy storage, e.g. in a switching current limiter.

Compared to the size of other hearing aid components, inductive components for energy storage are relatively bulky, and it is preferred to avoid adding inductive components for energy storage to the hearing aid design in order to save space.

The energy storage unit may comprise at least one capacitor for supplying current to the wireless communication unit, such as one capacitor for supplying current to the wireless communication unit.

The capacitance of the energy storage unit may be at least 47 μF, such as at least 100 μF, such as at least 200 μF.

The current limiting unit operates to limit the amount of current drawn from the power supply by the wireless communication unit and the energy storage unit.

The current limiting unit may comprise at least one resistor coupled in series between the power supply and the energy storage unit, such as one resistor coupled in series between the power supply and the energy storage unit.

The current limiting unit may have a resistance ranging from 5Ω-50Ω coupled in series between the power supply and the energy storage unit.

A ratio between an absolute value of an output impedance of the current limiting unit and an absolute value of an output impedance of the energy storage is larger than 5:1.

A power consumption of the wireless communication unit may range from 5-200 mW during wireless transmission.

Duration of on-going wireless communication of the wireless communication unit may range from 100 μs-10 ms.

The current limiting unit may comprise a current limiter, such as a switched current limiter, such as a switched capacitor current limiter, coupled in series between the power supply and the energy storage unit.

The hearing aid circuit may comprise a switched voltage converter, such as a switched capacitor voltage converter, such as a voltage doubler, coupled for supplying the wireless communication unit with a supply voltage that is larger than the power supply voltage.

The switched voltage converter may include the current limiting unit.

Preferably, the energy storage unit is coupled at the output of the switched voltage converter. The currents at the output side of the voltage converter are smaller than at the input side of the converter so that the energy storage unit will have to supply smaller peak currents than if coupled at the input side of the voltage converter, and also a capacitor with a specific capacitance value stores more energy with increased voltage. Further, influence of capacitor leakage current decreases with increased voltage.

The input transducer may comprise one or more microphones, each of which converts an acoustic signal applied to the microphone into a corresponding analogue audio signal in which the instantaneous voltage of the audio signal varies continuously with the sound pressure of the acoustic signal at the microphone.

The input transducer may also comprise a telecoil that converts a varying magnetic field at the telecoil into a corresponding varying analogue audio signal in which the instantaneous voltage of the audio signal varies continuously with the varying magnetic field strength at the telecoil.

Typically, the analogue audio signal is made suitable for digital signal processing by conversion into a corresponding digital audio signal in an analogue-to-digital converter whereby the amplitude of the analogue audio signal is represented by a binary number. In this way, a discrete-time and discrete-amplitude digital audio signal in the form of a sequence of digital values represents the continuous-time and continuous-amplitude analogue audio signal.

Throughout the present disclosure, the "audio signal" may be used to identify any analogue or digital signal forming part of the signal path from the output of the input transducer to an input of the hearing loss processor.

Throughout the present disclosure, the "hearing loss compensated audio signal" may be used to identify any analogue or digital signal forming part of the signal path from the output of the hearing loss processor to an input of the output transducer.

The wireless communication unit may be a device or a circuit comprising both a wireless transmitter and a wireless receiver. The transmitter and receiver may share common circuitry and/or a single housing. Alternatively, the transmitter and receiver may share no circuitry, and the wireless communication unit may comprise separate devices with the transmitter and the receiver, respectively.

The wireless communication may be performed according to a frequency diversification or spread spectrum scheme, i.e. the frequency range utilized by the hearing aid is divided into a number of frequency channels, and wireless transmissions switch channels according to a predetermined scheme so that transmissions are distributed over the frequency range.

A frequency hopping algorithm may be provided that allows devices in the network to calculate what frequency channel the network will use at any given point in time without relying on the history of the network, e.g. based on the present frequency channel number, a pseudo-random number generator calculates the next frequency channel number. This facilitates synchronization of a new device in with the hearing aid, e.g. the new device comprises the same pseudo-random number generator as the hearing aid. Thus, upon receipt of the current frequency channel number during acquisition, the new device will calculate the same next frequency channel number as the hearing aid.

Preferably, in a network, one device in the network is a master device. All other devices in the system synchronize to the timing of the master device, and preferably, the master device is a hearing aid, since the hearing aid user will always carry the hearing aid when he or she uses the network.

Every device in the network has its own identification number, e.g. a 32-bit number. Globally unique identities are not required since the probability of two users having hearing aids with identical identifications is negligible.

Preferably, a new device is automatically recognized by the network and interconnected with the network.

It is an advantage of a network operating according to a spread spectrum scheme that the communication has a low sensitivity to noise, since noise is typically present in specific frequency channels, and communication will only be performed in a specific frequency channel for a short time period after which communication is switched to another frequency channel.

Further, several networks may co-exist in close proximity, for example two or more hearing aid users may be present in the same room without network interference, since the probability of two networks simultaneously using a specific frequency channel will be very low. Likewise, the hearing aid network may coexist with other wireless networks utilizing the same frequency band, such as Bluetooth networks or other wireless local area networks.

The hearing aid may advantageously be incorporated into a binaural hearing aid system, wherein two hearing aids are interconnected, e.g., through a wireless network, for digital exchange of data, such as audio signals, signal processing parameters, control data, such as identification of signal processing programs, etc., etc., and optionally interconnected with other devices, such as a remote control, etc.

A hearing aid includes: an input transducer configured to output an audio signal based on a signal applied to the input transducer; a processor configured to compensate a hearing loss of a user of the hearing aid and output a hearing loss compensated audio signal; an output transducer configured to output an auditory output signal based on the hearing loss compensated audio signal, wherein the auditory output signal is to be received by a human auditory system; a wireless communication unit configured to communicate wirelessly with another device; an energy storage unit coupled to supply the wireless communication unit with power; and a current limiting unit coupled for control of replenishment of the energy storage unit with energy from a power supply.

Optionally, the energy storage unit comprises at least one capacitor for supplying current to the wireless communication unit.

Optionally, the energy storage unit comprises a single capacitor for supplying current to the wireless communication unit.

Optionally, a capacitance of the energy storage unit is at least 47 μF.

Optionally, the current limiting unit comprises at least one resistor coupled in series between the power supply and the energy storage unit.

Optionally, the current limiting unit comprises a single resistor coupled in series between the power supply and the energy storage unit.

Optionally, the current limiting unit has a resistance anywhere from 5Ω to 50Ω coupled in series between the power supply and the energy storage unit.

Optionally, a ratio between an absolute value of an output impedance of the current limiting unit and an absolute value of an output impedance of the energy storage is larger than 5:1.

Optionally, a power consumption of the wireless communication unit has a value that is anywhere from 5 mW to 200 mW during wireless transmission.

Optionally, a duration of wireless communication of the wireless communication unit has a value that is anywhere from 100 μs to 2 ms.

Optionally, the current limiting unit comprises a current limiter coupled in series between the power supply and the energy storage unit.

Optionally, the current limiter is a switched current limiter.

Optionally, the hearing aid further includes a switched voltage converter coupled between the power supply and the energy storage unit for providing a voltage for the wireless communication unit that is above a voltage of the power supply.

Optionally, the switched voltage converter is a voltage doubler.

Optionally, the switched voltage converter includes the current limiting unit.

Other aspects and features will be evident from reading the following detailed description.

BRIEF DESCRIPTION OF THE DRAWINGS

In the following, the new method and hearing aid is explained in more detail with reference to the drawings, wherein FIG. 1 Is a schematic diagram of one new hearing aid according to the appended claims, FIG. 2 Is a schematic diagram of another new hearing aid according to the appended claims, and FIG. 3 Shows plot of simulated currents during operation of the hearing aid of FIG. 2.

DETAILED DESCRIPTION OF THE DRAWINGS

Figure 1:
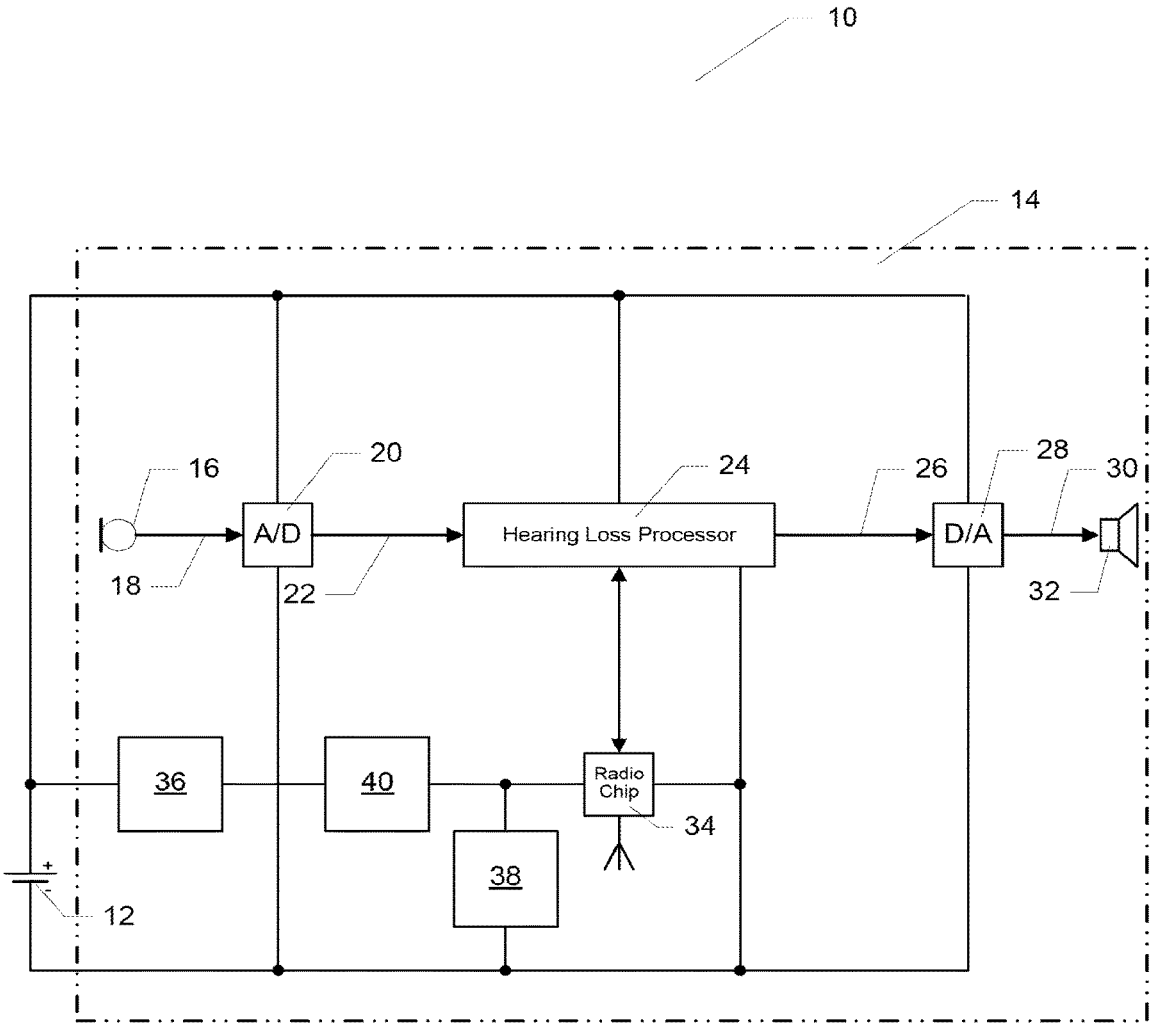

Various embodiments are described hereinafter with reference to the figures. Like reference numerals refer to like elements throughout. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

In the following, various examples of the new hearing aid are illustrated. The new hearing aid according to the appended claims may, however, be embodied in different forms and should not be construed as limited to the examples set forth herein.

FIG. 1 shows a schematic diagram of a new hearing aid 10 according to the appended claims.

The hearing aid 10 has a Zinc-air battery 12 that supplies power to the hearing aid circuit 14.

The hearing aid circuit 14 includes an input transducer 16 in the form of a microphone 16. The microphone 16 outputs an analogue audio signal 18 based on an acoustic sound signal arriving at the microphone 16 when the hearing aid 10 is operating.

An analogue-to-digital converter 20 converts the analogue audio signal 18 into a corresponding digital audio signal 22 for digital signal processing in the hearing aid circuit 14, in particular in the hearing loss processor 24 that is configured to compensate a hearing loss of a user of the hearing aid 10. Preferably, the hearing loss processor 24 comprises a dynamic range compressor well-known in the art for compensation of frequency dependent loss of dynamic range of the user often termed recruitment in the art. In this way, the hearing aid may be configured to restore loudness, such that loudness of the hearing loss compensated signal as perceived by the user wearing the hearing aid 10 substantially matches the loudness of the acoustic sound signal arriving at the microphone 16 as it would have been perceived by a listener with normal hearing. Accordingly, the hearing loss processor 24 outputs a digital hearing loss compensated audio signal 26.

A digital-to-analogue converter 28 converts the digital hearing loss compensated audio signal 26 into a corresponding analogue hearing loss compensated audio signal 30.

An output transducer in the form of a receiver 32 converts the analogue hearing loss compensated audio signal 30 into a corresponding acoustic signal for transmission towards an eardrum of the user, whereby the user hears the sound originally arriving at the microphone; however, compensated for the user's individual hearing loss.

The hearing aid circuit 14 further includes a wireless communication unit 34 in the form of a radio chip connected to an antenna and configured to communicate wirelessly with other devices, e.g. in a hearing aid network as is well-known in the art.

The radio chip may operate at a larger voltage than the output voltage of a conventional Zinc-air battery. Thus, in FIG. 1, a voltage doubler 36 is provided to supply power to the radio chip 34. The voltage doubler 36 and the current limiting unit 40 may be combined. However, in another example, a radio chip can be used that is capable of operating at the output voltage of a Zinc-air battery, and in such an example, the voltage doubler 36 may be omitted.

A radio chip 34 typically draws significant amounts of current during on-going wireless data transmission and data reception, e.g. ranging from 5 mA-50 mA. A Zinc-air battery is only capable of supplying the required amount of current during a short time period, typically a few milliseconds. Continued supply of the required amount of current may lead to a lowered supply voltage below which one or more other parts of the hearing aid, e.g. the digital signal processing circuitry, may stop operating properly. Further, the Zinc-air battery requires time to recover after having supplied current to the radio chip 34 during its communication. Therefore, typically the radio chip duty cycle, i.e. the percentage of radio turn-on time with respect to the sum of the radio turn-on and radio turn-off time, should be kept below 15%-20% depending on current values and battery performance.

Communication between devices, e.g. in a network, may be synchronized so that every device, e.g. in the network, knows when to transmit and when to receive. Communication, i.e. reception and/or transmission, may be performed in short bursts, which e.g. may be in a range of 10 μs to 10 ms, such as in a range of 100 μs to 1 ms, such as in a range of 400 μs to 800 μs, such as around 600 μs.

The hearing aid 10 further comprises an energy storage unit 38 that is connected to the communication unit 34 for power supply of the communication unit 34 so that the main power for the communication unit 34 during on-going wireless data transmission or data reception of the communication unit 34 is supplied from the energy storage unit 38, thereby relieving the battery 12 from supplying these peak current loads, and thereby avoiding significant voltage drops of the power supply for the hearing aid circuit 14. The energy storage unit 38 has low output impedance.

The energy storage unit 38 is further connected to the power supply 12 through a current limiting unit 40 for replenishment of the energy storage unit 38 with energy from the power supply 12, whereby the energy storage unit 38 draws lower peak currents from the power supply 12 than if the current limiting unit 40 had been absent.

The current limiting unit 40 may be a switched current limiting unit, such as a switched capacitor current limiting unit; however, preferably, the current limiting unit does not contain an inductive component.

Compared to the size of other hearing aid components, inductive components are relatively bulky, and it is preferred to avoid adding inductive components to the hearing aid design in order to save space.

The energy storage unit 38 may comprise one or more capacitors for supplying current to the wireless communication unit 34. The capacitor(s) should have a low ESR (equivalent series resistance) facilitating delivery of the peak currents for the communication unit 34.

The capacitance of the energy storage unit may be at least 47 μF, such as at least 100 μF, such as at least 200 μF.

A ratio between an absolute value of an output impedance of the current limiting unit 40 and an absolute value of an output impedance of the energy storage is larger than 5:1 so that the peak currents for the communication unit 34 are delivered from the energy storage unit 38.

The current limiting unit 40 may have a resistance ranging from 5Ω-50Ω coupled in series between the power supply and the energy storage unit so that the peak currents for the communication unit 34 are delivered from the energy storage unit 38.

The current limiting unit 40 may comprise one or more resistors coupled in series between the power supply 12 and the energy storage unit 38.

A power consumption of the wireless communication unit may range from 20-200 mW during wireless transmission.

Duration of wireless communication of the wireless communication unit may range from 100 μs-2 ms.

As shown in FIG. 1, the energy storage unit 38 is preferably coupled at the output of the switched voltage converter 36. The currents at the output side of the voltage converter 36 are smaller than at the input side of the converter 36 so that the energy storage unit 38 will have to supply smaller peak currents than if coupled at the input side of the voltage converter 36, and also a capacitor with a specific capacitance value can store more energy with increased voltage. Further, influence of capacitor leakage current decreases with increased voltage.

Figure 2:
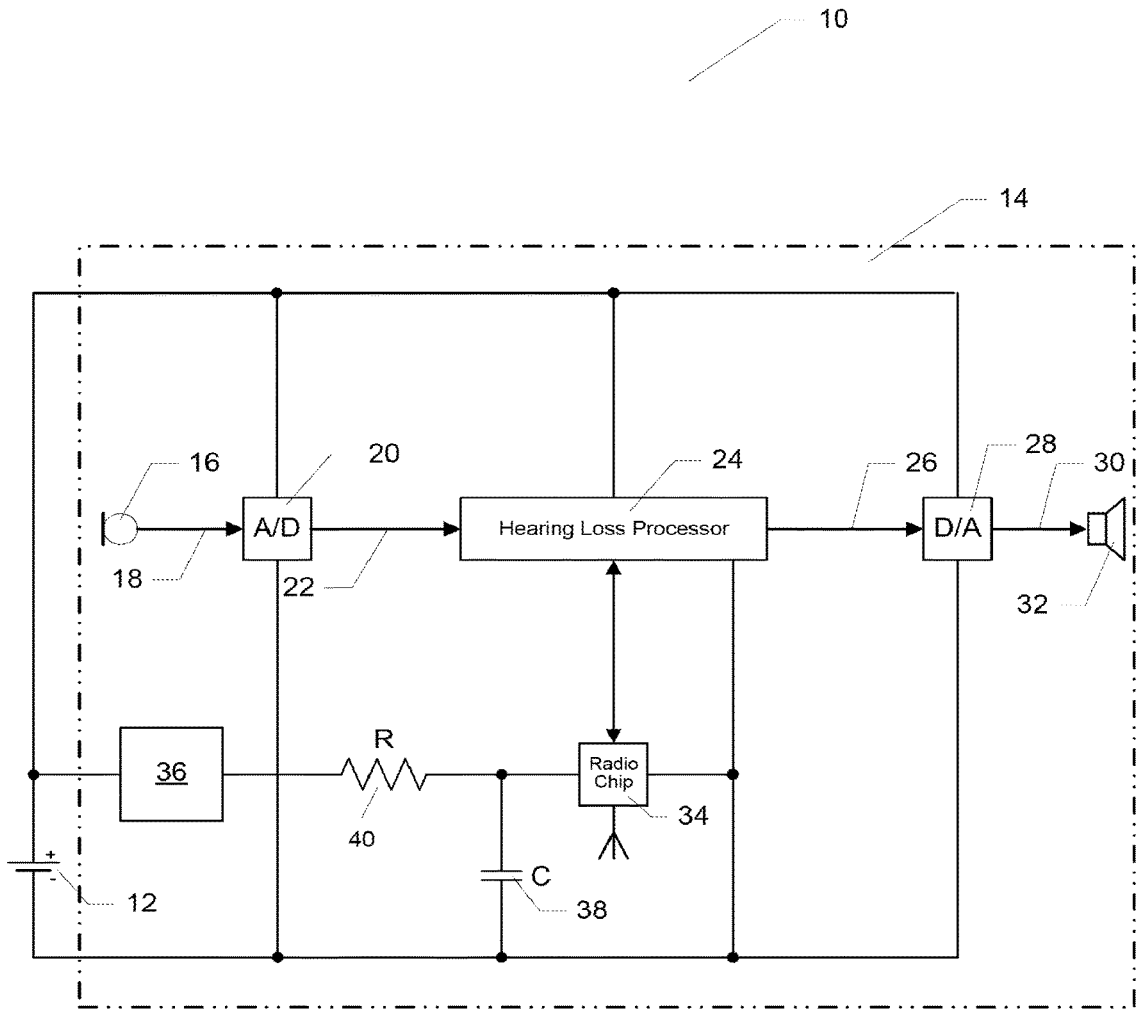

FIG. 2 shows a schematic diagram of a new hearing aid 10 identical to the hearing aid shown in FIG. 2 except for the fact that the current limiting unit is constituted by a single resistor 40, e.g. a 10Ω resistor, and the energy storage unit is constituted by a single capacitor 38, e.g. a 220 μF capacitor with an ESR of 1Ω-2Ω.

Figure 3:
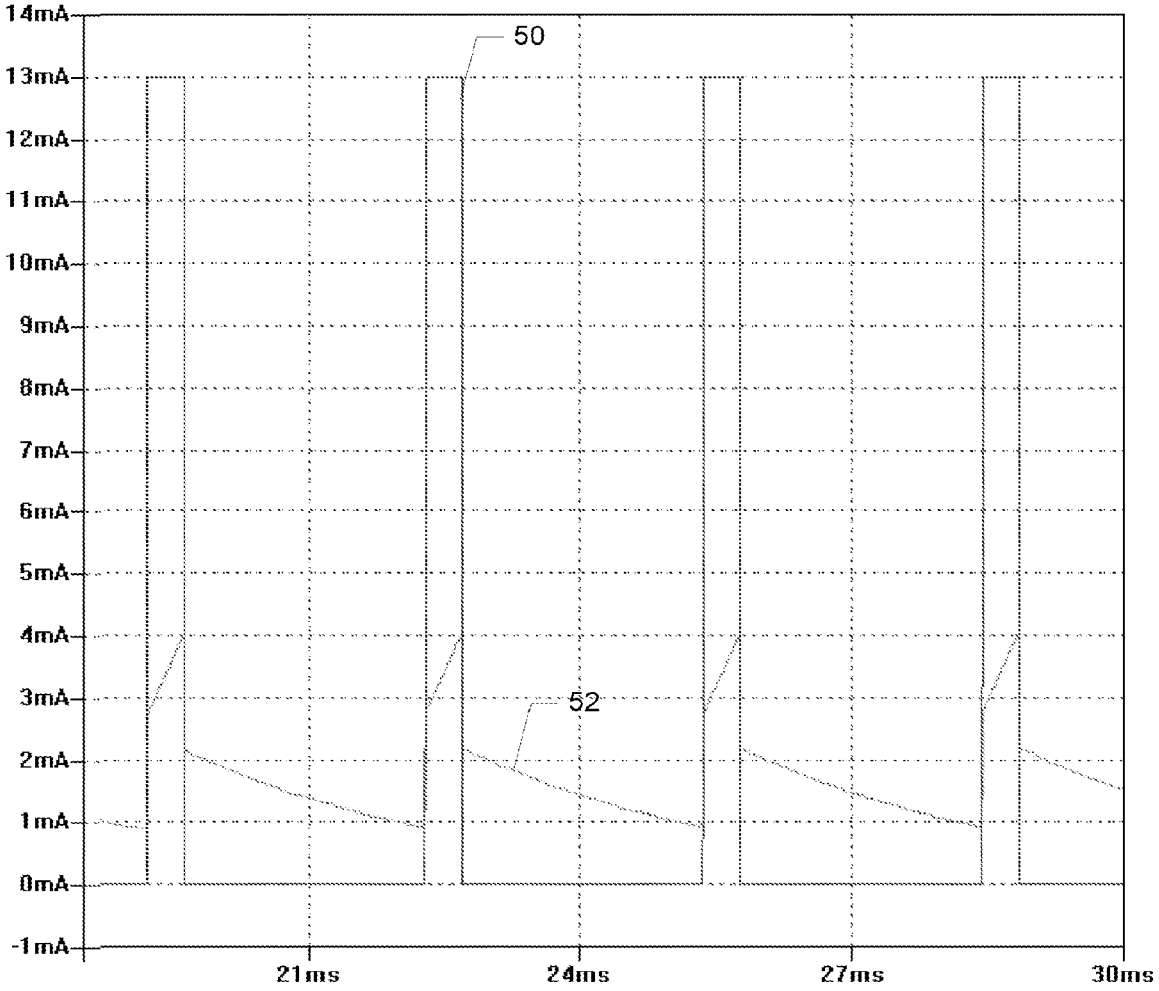

FIG. 3 shows simulated currents of the hearing aid 10 shown in FIG. 2. The square current trace 50 shows the current drawn by the radio chip 34 showing the peak currents during on-going data transmission or reception, and the lower current trace 52 shows the current flowing through the resistor 40. It should be noted that the current supplied to the voltage doubler 36 has half the value of current trace 52.

Although particular embodiments have been shown and described, it will be understood that it is not intended to limit the claimed inventions to the preferred embodiments, and it will be obvious to those skilled in the art that various changes and modifications may be made without department from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A hearing aid comprising:

an input transducer configured to output an audio signal based on a signal applied to the input transducer;

a processor configured to compensate a hearing loss of a user of the hearing aid and output a hearing loss compensated audio signal;

an output transducer configured to output an auditory output signal based on the hearing loss compensated audio signal, wherein the auditory output signal is to be received by a human auditory system;

a wireless communication unit configured to communicate wirelessly with another device;

an energy storage unit coupled to supply the wireless communication unit with power; and a current limiting unit coupled for control of replenishment of the energy storage unit with energy from a power supply;

wherein an absolute value of an output impedance of the current limiting unit is larger than an absolute value of an output impedance of the energy storage.

2. The hearing aid according to claim 1, wherein the energy storage unit comprises at least one capacitor for supplying current to the wireless communication unit.

3. The hearing aid according to claim 2, wherein the energy storage unit comprises only a single capacitor for supplying current to the wireless communication unit.

4. The hearing aid according to claim 1, wherein a capacitance of the energy storage unit is at least 47 μF.

5. The hearing aid according to claim 1, wherein the current limiting unit comprises at least one resistor coupled in series between the power supply and the energy storage unit.

6. The hearing aid according to claim 1, wherein the current limiting unit comprises only a single resistor coupled in series between the power supply and the energy storage unit.

7. The hearing aid according to claim 1, wherein a ratio between the absolute value of the output impedance of the current limiting unit and the absolute value of the output impedance of the energy storage is larger than 5:1.

8. The hearing aid according to claim 1, wherein a power consumption of the wireless communication unit has a value that is anywhere from 5 mW to 200 mW during wireless transmission.

9. The hearing aid according to claim 1, wherein a duration of wireless communication of the wireless communication unit has a value that is anywhere from 100 μs to 2 ms.

10. The hearing aid according to claim 1, wherein the current limiting unit comprises a current limiter coupled in series between the power supply and the energy storage unit.

11. The hearing aid according to claim 1, wherein the current limiting unit is a switched current limiter.

12. The hearing aid according to claim 1, wherein the current limiting unit comprises a switched capacitor current limiter.

13. The hearing aid according to claim 1, further comprising a switched voltage converter coupled between the power supply and the energy storage unit for providing a voltage for the wireless communication unit that is above a voltage of the power supply.

14. The hearing aid according to claim 13, wherein the switched voltage converter is configured to increase a voltage.

15. The hearing aid according to claim 14, wherein the switched voltage converter comprises a voltage doubler.

16. The hearing aid according to claim 13, wherein the switched voltage converter includes the current limiting unit.

17. The hearing aid according to claim 1, wherein the current limiting unit is configured to cause the energy storage unit to draw a lower peak current from the power supply.

18. A hearing aid comprising:

an input transducer configured to output an audio signal based on a signal applied to the input transducer;

a processor configured to compensate a hearing loss of a user of the hearing aid and output a hearing loss compensated audio signal;

an output transducer configured to output an auditory output signal based on the hearing loss compensated audio signal, wherein the auditory output signal is to be received by a human auditory system;

a wireless communication unit configured to communicate wirelessly with another device;

an energy storage unit coupled to supply the wireless communication unit with power; and a current limiting unit coupled for control of replenishment of the energy storage unit with energy from a power supply;

wherein the current limiting unit comprises a resistor that is a physical electrical component, the resistor being coupled in series between the power supply and the energy storage unit.

19. A hearing aid comprising:

an input transducer configured to output an audio signal based on a signal applied to the input transducer;

a processor configured to compensate a hearing loss of a user of the hearing aid and output a hearing loss compensated audio signal;

an output transducer configured to output an auditory output signal based on the hearing loss compensated audio signal, wherein the auditory output signal is to be received by a human auditory system;

a wireless communication unit configured to communicate wirelessly with another device;

an energy storage unit coupled to supply the wireless communication unit with power;

a current limiting unit coupled to the energy storage unit, the current limiting unit configured to lower a peak current provided to the energy storage unit; and a switched voltage converter coupled between the power supply and the energy storage unit for providing a voltage for the wireless communication unit that is different from a voltage of a power supply configured to provide energy for the energy storage unit;

wherein (1) an absolute value of an output impedance of the current limiting unit is larger than an absolute value of an output impedance of the energy storage, and/or (2) the current limiting unit has a resistance that corresponds with a peak current for the wireless communication unit.

20. The hearing aid according to claim 19, wherein the switched voltage converter is a voltage doubler.

21. The hearing aid according to claim 19, wherein the switched voltage converter includes the current limiting unit.

22. The hearing aid according to claim 19, wherein the switched voltage converter comprises a switched capacitor voltage converter.

23. The hearing aid according to claim 19, wherein the current limiting unit is configured to cause the energy storage unit to draw a lower peak current from the power supply.

24. The hearing aid according to claim 19, wherein the switched voltage converter is configured to increase an input voltage received by the switched voltage converter.

25. A hearing aid comprising:

an input transducer configured to output an audio signal based on a signal applied to the input transducer;

a processor configured to compensate a hearing loss of a user of the hearing aid and output a hearing loss compensated audio signal;

an output transducer configured to output an auditory output signal based on the hearing loss compensated audio signal, wherein the auditory output signal is to be received by a human auditory system;

a wireless communication unit configured to communicate wirelessly with another device;

an energy storage unit coupled to supply the wireless communication unit with power;

a current limiting unit coupled to the energy storage unit; and a switched voltage converter coupled between the power supply and the energy storage unit for providing a voltage for the wireless communication unit that is different from a voltage of a power supply configured to provide energy for the energy storage unit;

wherein the current limiting unit comprises a resistor that is a physical electrical component, the resistor being coupled in series between the power supply and the energy storage unit.

26. A hearing aid comprising:

an input transducer configured to output an audio signal based on a signal applied to the input transducer;

a processor configured to compensate a hearing loss of a user of the hearing aid and output a hearing loss compensated audio signal;

an output transducer configured to output an auditory output signal based on the hearing loss compensated audio signal, wherein the auditory output signal is to be received by a human auditory system;

a wireless communication unit configured to communicate wirelessly with another device;

an energy storage unit coupled to supply the wireless communication unit with power; and a current limiting unit coupled for control of replenishment of the energy storage unit with energy from a power supply;

wherein the current limiting unit has a resistance that corresponds with a peak current for the wireless communication unit.

27. The hearing aid according to claim 26, wherein the current limiting unit has a resistance anywhere from 5Ω to 50Ω coupled in series between the power supply and the energy storage unit.

* * * * *